United States Patent [19]

Watkins

[11] 3,993,129

[45] Nov. 23, 1976

[54] FLUID INJECTION VALVE FOR WELLS

[75] Inventor: Fred E. Watkins, Houston, Tex.

[73] Assignee: Camco, Incorporated, Houston, Tex.

[22] Filed: Sept. 26, 1975

[21] Appl. No.: 616,963

[52] U.S. Cl. ..... 166/319; 137/155
[51] Int. Cl.[2] ..... E21B 43/12
[58] Field of Search ..... 166/224 R, 224 A; 137/155, 494, 510

[56] References Cited

UNITED STATES PATENTS

| | | | |
|---|---|---|---|
| 2,465,060 | 3/1949 | Carlisle et al. | 137/155 |
| 2,556,867 | 6/1951 | Carlisle et al. | 137/155 |
| 3,208,398 | 9/1965 | Douglas | 137/155 |
| 3,324,803 | 6/1967 | Kelley et al. | 137/155 |
| 3,363,581 | 1/1968 | Kelley et al. | 137/155 |
| 3,741,299 | 6/1973 | Terral | 166/117.5 |
| 3,792,714 | 2/1974 | Miller | 137/494 |

*Primary Examiner*—James A. Leppink
*Attorney, Agent, or Firm*—Fulbright & Jaworski

[57] ABSTRACT

A fluid injection valve for use in a well tubing having an opening therein in which the valve controls the flow of fluid flowing between the outside of the tubing and the inside of the tubing through the opening. A spring-loaded relief valve element yieldably closes a port in the valve against the flow of fluid and a closed flexible pressurized chamber is provided with one end being movably positioned against the valve element. The exterior of the chamber is exposed to the valve outlet pressure so that in the event that the outlet pressure drops below a predetermined amount, the chamber will expand and act against the valve element to close the valve. The chamber may be a bellows and the cross-sectional area of the chamber is preferably greater than the cross-sectional area of the port to provide a closure force sufficient to overcome a hydrostatic head outside of the tubing.

5 Claims, 6 Drawing Figures

FLUID INJECTION VALVE FOR WELLS

BACKGROUND OF THE INVENTION

Fluid or chemical injection valves for controlling the flow of fluid between the annulus between the well tubing and the well casing and the inside of the tubing are old. Typically, such valves are spring-loaded relief valves which are installed in the tubing string with the valve sealing off a port that communicates between the interior of the tubing and the annulus between the tubing and the casing. In one type of valve, the valve is set to a desired opening pressure and will open and allow fluid to be injected into the tubing when the annulus pressure exceeds the tubing pressure by the present value. In another type of valve for injecting chemicals from the tubing to the annulus, the valve is actuated when the tubing pressure exceeds the annulus pressure by a present value. However, it is a common practice to install a safety valve in the flow of well production below the injection valve. If the safety valve closes, the pressure above the safety valve and adjacent the injection valve drops considerably. When this happens, the differential between the casing annulus pressure and the tubing pressure changes proportionately thereby causing the injection valve to open and increases the flow of fluid through the injection valve. Since a typical installation may have several thousand feet of chemical fluid acting against the valve inlet, the fluid creates a hydrostatic pressure at the injection valve depth. The opening pressure of the injection valve is usually set so that a minimum of surface injection pressure in addition to the hydrostatic head is required to open the injection valve at normal producing pressure valves. Therefore, if the normal producing tubing pressure falls as a result of a subsurface safety valve closure, the hydrostatic head of the injected fluid may flow through the injection valve causing the loss of considerable fluid and possibly loading up the flow of well production so that the well cannot produce. The present invention is directed to an improved fluid or chemical injection valve which provides a closure force sufficient to overcome the hydrostatic head of the injected fluid in the event that the producing well pressure drops a predetermined amount below normal producing well pressure values.

SUMMARY

The present invention is directed to an improved fluid injection valve which includes means for providing an increased valve closing force in the event that the pressure of the flow of well production drops below a predetermined amount.

A still further object of the present invention is the provision of a fluid injection valve which is provided with a closed flexible pressurized chamber carried by the valve having first and second ends with the first end being movably positioned adjacent the valve element but the movement of the second end is limited by the valve. The exterior of the chamber is exposed to outlet pressure of the valve and when the valve is positioned in the tubing, the chamber will be exposed to the pressure of the well production, so that if the production pressure falls below a predetermined amount, the chamber will expand and will contact the valve element and urge it towards the closed position.

Still a further object of the present invention is the provision of fluid injection valves for use in a well tubing which has an opening therein in which the valves control the flow of fluid from the outside of the tubing into the tubing through the opening or control the flow of fluid from the inside of the tubing to the outside of the tubing. The valves include a housing and a port in the housing adapted to communicate with the tubing opening when the valve is placed in the tubing, and seal means are provided on both sides of the port sealing against the tubing and about the opening. A spring-loaded relief valve element is yieldably urge to close the port against the flow of fluid. A closed, flexible pressurized chamber carried by the valve has first and second ends with the first end being movably positioned adjacent the valve element but the movement of the second end is limited by the valve housing. A passageway in the housing communicates between the exterior of the pressurized chamber and the exterior of the housing and with the outlet of the port whereby when the valve is positioned in the tubing the exterior of the chamber will be exposed to the valve outlet pressure so that if the well production pressure or valve outlet pressure falls below a predetermined amount the chamber will expand, contact, and urge the valve element towards the closed position.

Preferably, the chamber is a bellows and the cross-sectional area of the bellows is greater than the cross-sectional area of the valve port to provide a greater closing force and the second end of the bellows is fixedly secured to the housing.

Other and further features and advantages will be readily apparent from the following description of a preferred embodiment of the invention.

DESCRIPTION OF THE PEFERRED EMBODIMENTS

Figure 1:
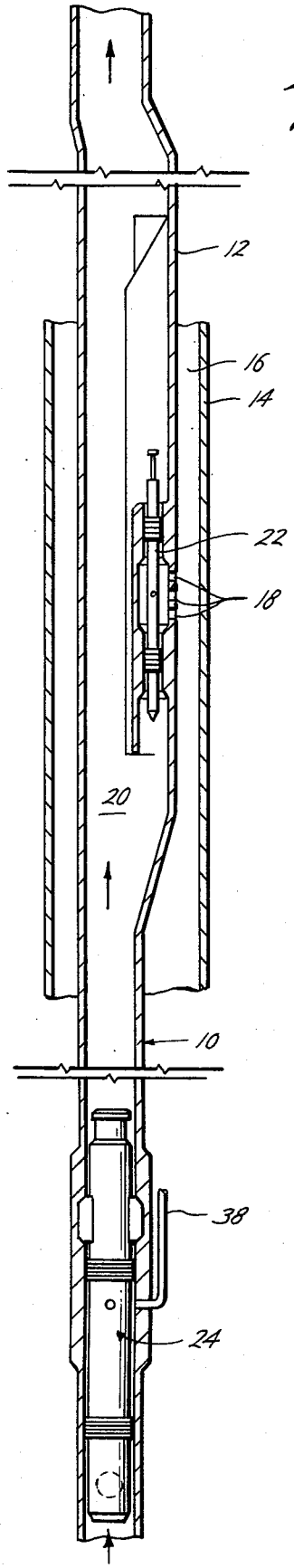
FIG. 1 is a fragmentary elevational view of a well in which the valve of the present invention is shown installed controlled fluid injection from the outside to the inside of the tubing.

Referring now to the drawings, and particularly to FIG. 1, a fragmentary view of a well is shown in which a tubing, generally indicated by the reference numeral 10, is provided extending from the well surface and may include a conventional sidepocket mandrel 12. The tubing 10 is surrounded by the casing 14 thereby providing an annulus 16 between the exterior of the tubing 10 and the interior of the casing 14. The mandrel 12 includes one or more openings 18 in the wall thereof providing communication between the annulus 16 and the interior 20 of the tubing 10. A fluid or chemical injection valve 22 may be conventionally inserted in the sidepocket of the mandrel 12 in communication with the openings 18 to control the flow of fluid from the annulus 16 into the interior 20 of the tubing 10. A typical installation has several thousand feet of fluid in the annulus 16 creating a hydrostatic pressure at the depth of the valve 22. Conventional chemical injection valves are spring-loaded relief valves which are subjected on one side to the fluid pressure in the interior 20 of the tubing 10 and on the second side to the fluid pressure in the annulus 16. The valves are generally preset to a desired opening pressure and will open and allow fluid passed from the annulus 16 into the interior 20 of the tubing 10 when the pressure in the annulus 16 exceeds the pressure inside of the tubing by the preset amount. The opening pressure of the injection valves is usually set so that a minimum of surface injection pressure in addition to the hydrostatic head of the fluid in the annulus 16 is required to open the injection valve at normal producing tubing pressure valves.

However, it is a common practice to install a conventional safety valve, generally indicated by the reference numeral 24, in the tubing 10 below the injection valve 22. If the safety valve 24 closes, the pressure in the tubing 10 above the safety valve 24 and adjacent the injection valve 22 decreases. When this happens, the differential between the pressure in the casing annulus 16 and the tubing interior 20 increases proportionately thereby increasing the flow of fluid through the injection valve 22 into the tubing 10. In this event, the hydrostatic head in the annulus may fall several hundred feet and flow into the tubing 10 causing the loss of considerable fluid and possibly loading up of the tubing 10 so that the well cannot produce.

The present invention is directed to an improved fluid injection valve 22 which provides a closing force sufficient to overcome the hydrostatic head in the annulus 16 in the event that the tubing pressure in the interior 20 of the tubing 10 drops a predetermined amount below normal producing well pressure values.

Figure 2:
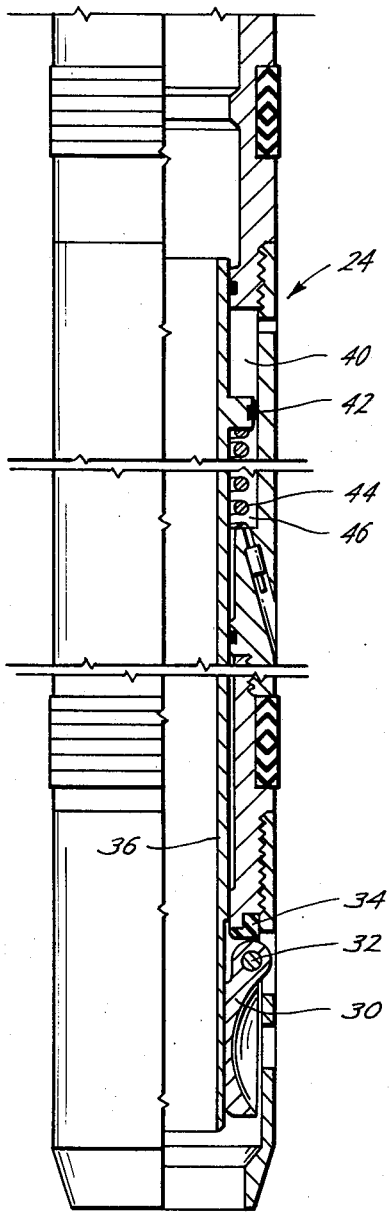
FIG. 2 is an enlarged cross-sectional fragmentary view of the safety valve shown in FIG. 1.

The safety valve 24 is conventional, and may be any suitable type of safety valve such as the type PC sold by Camco, Incorporated. The schematic of operation of one type safety valve is illustrated in FIG. 2. The valve 24 may include a flapper valve 30 pivotally supported from a pin 32 and arranged to close on a seat 34 by action of a spring (not shown). A flow tube 36 is actuated in a downwardly direction by fluid being injected from the surface through a flow line 38 into a chamber 40 and acting against a piston 42. Downward movement of the flow tube 36 holds the valve 30 in the open position. Upon decrease of fluid pressure in the chamber 40, a spring 44 and pressurized chamber 46 act to move the flow tube 36 upwardly, allowing the flapper 30 to close the safety valve 24.

Figure 4:
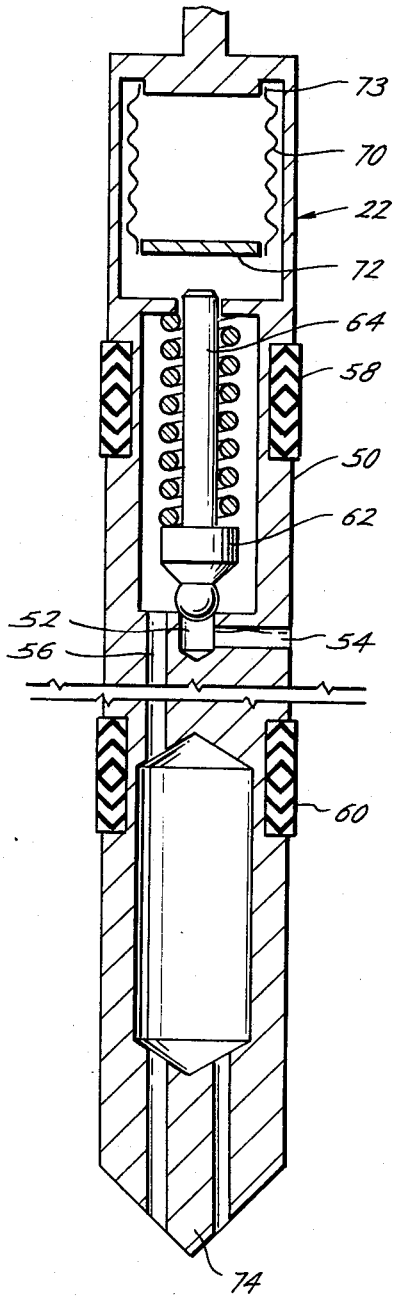
FIG. 4 is a view similar to FIG. 3 in which the pressurized chamber is contracted thereby allowing the valve to be controlled independently of the pressurized chamber.

Referring now to FIG. 4, the improved fluid injection valve 22 of the present invention is best seen. The valve 22 includes a housing 50 and a port 52 which is in communication with fluid inlet passageway 54 and fluid outlet passageway 56. When the valve 22 is inserted in the sidepocket of the mandrel 12, as best seen in FIG. 1, the port 52 and passageways 54 and 56 are placed in communication with the openings 18 in the tubing 10. Upper 58 and lower 60 seals are provided whereby the valve 22 seals in the sidepocket of the mandrel 12 about the openings 18 whereby the opening and closing of the port 52 controls the admission of fluid from the annulus 16 into the tubing 10 through a valve opening 74. A valve element 62 is provided to seat on the port 52 and may include an elongate stem 64. The valve element 62 is yieldably urged to a closing position against the port 52 by a spring 66. Such a structure is conventional. Therefore, the force acting on the valve element 62 to open the valve is proportional to the fluid pressure in the annulus 16 which includes the fluid injection pressure at the well surface and the hydrostatic head of the fluid in the annulus 16. The forces acting to close the valve element 62 include the spring 66 and the pressure inside of the tubing 10 acting on the back side of the valve element 62. The valve 22 is preset by the spring 66 to a desired opening pressure so as to open and allow fluid passage between the annulus 16 and the interior 20 of the tubing 10 when the annulus pressure exceeds the tubing pressure by the preset amount.

However, in the event that the safety valve 24 closes or if for any other reason, the pressure in the interior 20 of the tubing 10 drops to an abnormal value, the differential between the pressure in the annulus 16 and the pressure in the interior 20 of the tubing 10 increases thereby undesirably increasing the flow of fluid through the valve into the tubing 10.

A closed flexible pressurized chamber 70 is provided, preferably in the form of a bellows, to provide a closure force sufficient to overcome the hydrostatic head in the annulus 16 when the pressure in the tubing 10 drops below normal. The exterior of the closed chamber 70 is exposed to the pressure in the interior 20 of the tubing 10, such as through valve opening 74, and outlet passage 56. The chamber 70 is supported by the housing 50 with the first end 72 being movably positioned adjacent the stem 64 of the valve element 62. The second end 74 of the chamber 70 has its movement limited such as by being secured to the housing 50 whereby the first end 72 will move towards and away from the valve stem 64 as the chamber expands and retracts. The gas pressure in the chamber 70 is preset relative to the normal pressure in the tubing 10 so that the first end 72 is normally positioned out of the path of movement of the stem 64, as best seen in FIG. 4. The spring-loaded relief element 62 in this event may function normally without interference by the chamber 70.

Figure 3:
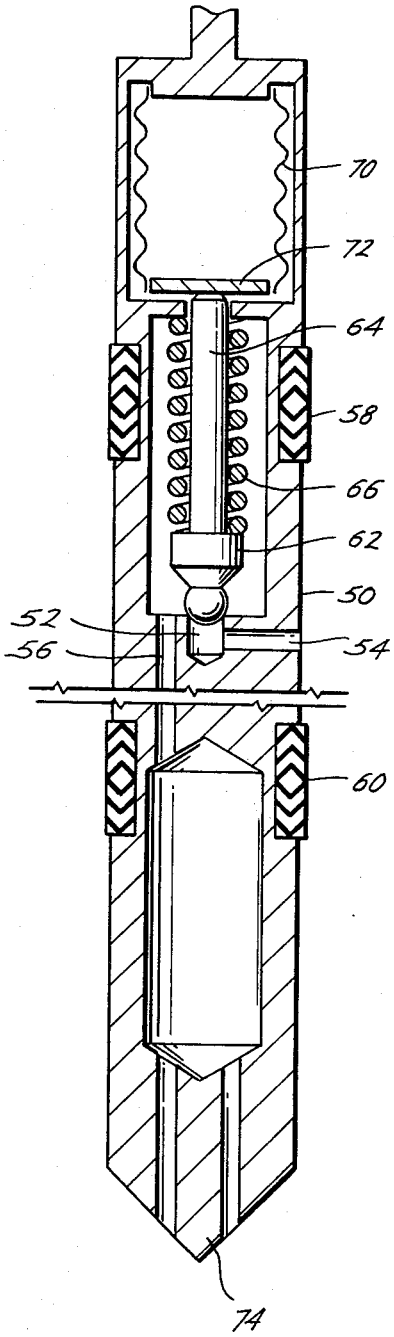
FIG. 3 is an enlarged cross-sectional view of the fluid injection valve of FIG. 1 shown with the pressurized chamber expanded for holding the valve in the closed position.

As best seen in FIG. 3, in the event that the pressure in the tubing 10 decreases beyond normal, the pressurized chamber 70 will expand and the first end 72 will be urged into engagement with the stem 64 urging the valve element 62 to the closed position on the port 52 to overcome the hydro-static head in the annulus 16. Preferably, the cross-sectional area of the bellows 70 is significantly greater than the port 52 whereby a slight difference of bellows pressure over the value of the tubing pressure will create a sufficient force to hold the valve element 62 seated against the port 52.

Figure 5:
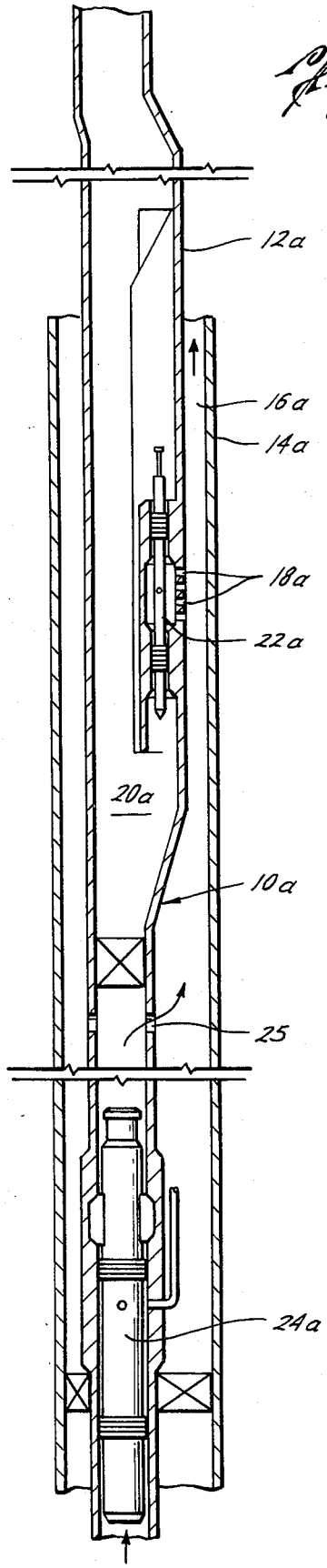
FIG. 5 is a fragmentary elevational view of a well in which a modified valve of the present invention is shown installed controlling fluid injection from the inside of the tubing to the outside of the tubing.
Figure 6:
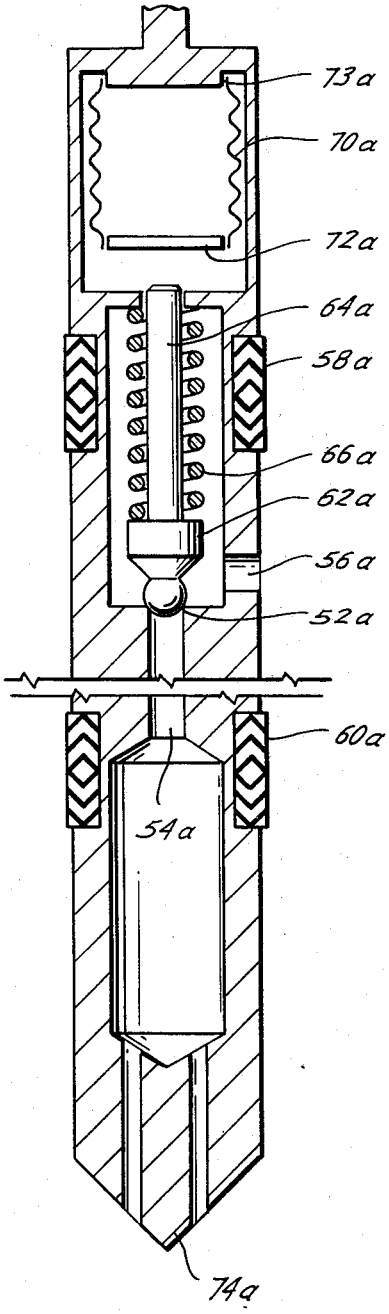
FIG. 6 is an enlarged cross-sectional view of the fluid injection valve of FIG. 5.

The embodiment of FIGS. 1–4 is for the case where the well production was upwardly through the tubing 10 and the fluid injection was from the annulus 16 to the interior 20 of the tubing 10. Another embodiment is shown in FIGS. 5 and 6 in which the well production is upwardly through the annulus and the fluid injection is from the interior of the tubing to the annulus. For convenience of reference, like parts in FIGS. 5 and 6 are numbered corresponding to like parts in FIGS. 5 and 6 are numbered corresponding to like parts in FIGS. 1–4 with the addition of the suffix *a*.

Referring now to FIG. 5, a fragmentary view of a well is shown in which a tubing 10*a* may include a conventional sidepocket mandrel 12*a* surrounded by a casing 14*a* thereby providing an annulus 16*a* between the tubing 10*a* and the casing 14*a*. A fluid or chemical injection valve 22*a* may be conventionally inserted in the sidepocket of the mandrels 12*a* in communication with mandrel openings 18*a* to control the flow of fluid from the interior 20*a* of the tubing 20*a* to the annulus 16*a*. In this case, the well production flows up the annulus 16*a* from openings 25 in the tubing 10*a* through a safety valve 24*a* which may be identical to that shown in FIGS. 1 and 2. The valve 22*a* is generally preset to a desired opening pressure and will open and allow fluid passage from the interior 20 of the tubing 10 into the annulus 16*a* when the pressure in the interior 20*a* exceeds the pressure in the annulus 16*a* by a preset amount. However, if the safety valve 24*a* closes, the pressure in the annulus 26*a* decreases and the differential between the pressure in the interior 20*a* and the casing annulus 16*a* increases proportionally thereby undesirably increasing the flow of injected fluid through the injection valve 22*a* into the annulus 16*a*.

The injection valve 22*a*, as best seen in FIG. 6, is identical to the valve illustrated in FIGS. 1 – 4. except that the inlet and outlet has been reversed. That is, the inlet passageway 54*a* is in communication with the interior 20*a* of the tubing 10*a* and the outlet 56*a*is in communication to the annulus 16*a*. Thus the retraction and extension of the chamber 70*a* is still subject to the pressure of the well production through the outlet 56*a*. So long as the pressure in annulus 16 is above a predetermined amount, the chamber 70*a* will be contracted and the first end 72*a* is positioned out of the path of the movement of the stem 64*a* and the spring-loaded release element 62*a* may function normally in response to the pressure of the injected fluids through the inlet 54*a* without interference by the chamber 70*a*.

However, in the event that the pressure in the annulus 16*a* decreases beyond normal, such as by a change of the safety valve 24*a*, pressurized chamber 70*a* will expand and the first end 72*a* will be urged into engagement with the stem 64*a* urging the valve element 62*a* to the closed position on the port 52*a* to overcome the hydrostatic head in the interior 20*a* of the tubing 10*a*.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. In a fluid injection valve for use in a well tubing for controlling the flow of fluid between the outside and the inside of the tubing through an opening in the tubing in which the valve includes a port, an inlet and an outlet adapted to be placed in communication with said opening and a spring-loaded relief valve yieldably closing said port against the flow of fluid from the inlet to the outlet, the improvement comprising, a closed flexible pressurized chamber carried by the valve and having first and second ends, the first end being movably positioned adjacent to but unconnected to the valve element and the movement of the second end being limited by the valve, and a passageway in the valve communicating between the exterior of the chamber and the outlet of the valve whereby when the valve is positioned in the tubing the exterior of the chamber will be exposed to the outlet pressure so that if the outlet pressure is below a predetermined amount the chamber will expand and urge the valve element towards the closed position, but if the outlet pressure is above a predetermined amount the chamber will contract without actuating the valve element.

2. The apparatus of claim 1 wherein the cross-sectional area of the chamber is greater than the cross-sectional area of the port.

3. In a fluid injection valve for use in a well tubing for controlling the flow of fluid from the outside of the tubing into the tubing through an opening in the tubing in which the valve includes a port adapted to be placed in communication with said opening and a spring-loaded relief valve element yieldably closing said port against the flow of fluid from outside of the tubing toward the inside of the tubing, the improvement comprising, a closed flexible pressurized chamber carried by the valve and having first and second ends, the first end being movably positioned adjacent to but unconnected to the valve element and the movement of the second end being limited by the valve, and a passageway in the valve communicating between the exterior of the chamber and the exterior of the valve at a position downstream of the port whereby when the valve is positioned in the tubing the exterior of the chamber will be exposed to the pressure in the tubing so that if the pressure in the tubing is below a predetermined amount the chamber will expand and urge the valve element towards the closed position, but if the pressure downstream of the port is above a predetermined amount the chamber will contract without actuating the valve element.

4. A fluid injection valve for use in a well tubing having an opening therein for controlling the flow of fluid from the outside of the tubing into the tubing through the opening comprising, a housing, a port in the housing adapted to communicate with the tubing opening when the valve is placed in the tubing, seal means on both sides of the port sealing againt the tubing, a spring-loaded relief valve element yieldably closing said port against the flow of fluid from outside the tubing towards the inside of said tubing, a closed flexible pressurized chamber carried by the valve having first and second ends, the first end being movably positioned adjacent to but unconnected to the valve element and the movement of the second end being limited by the valve housing, and a passageway in the housing communicating between the exterior of the chamber and the exterior of the housing downstream of the port whereby when the valve is positioned in the tubing the exterior of the chamber will be exposed to the pressure in the tubing so that if the pressure in tubing is below a predetermined amount the chamber will expand and urge the valve element toward the closed position, but if the tubing pressure is above a predetermined amount the chamber will contract without actuating the valve element.

5. In a fluid injection valve for use in well tubing for controlling the flow of fluid from the inside of the tubing to the outside of the tubing through an opening in the tubing in which the valve includes a port adapted to be placed in communication with said opening and a spring-loaded relief valve element yieldably closing said port against the tubing, the improvement comprising, a closed flexible pressurized chamber carried by the valve and having first and second ends, the first end being movably positioned adjacent to but unconnected to the valve element and the movement of the second end being limited by the valve, and a passageway in the valve communicating between both the backside of the valve element and the exterior of the chamber with the exterior of the valve at a position downstream of the port whereby when the valve is positioned in the tubing the exterior of the chamber will be exposed to the pressure outside of the tubing so that if the pressure outside of the tubing is below a predetermined amount the chamber will expand and urge the valve element towards the closed position, but if the pressure outside of the tubing is above a predetermined amount the chamber will contract without actuating the valve element.

* * * * *

UNITED STATES PATENT OFFICE

CERTIFICATE OF CORRECTION

PATENT NO. : 3,993,129

DATED : November 23, 1976

INVENTOR(S) : Fred E. Watkins

It is certified that error appears in the above-identified patent and that said Letters Patent are hereby corrected as shown below:

Column 1, line 19, change "present" to --preset--
Column 3, line 13, change "passed" to --passage--
Column 5, line 40, change "change" to --closure--

Signed and Sealed this

Eighth Day of February 1977

[SEAL]

*Attest:*

RUTH C. MASON
*Attesting Officer*

C. MARSHALL DANN
*Commissioner of Patents and Trademarks*